US007066071B2

(12) United States Patent
Zeder et al.

(10) Patent No.: US 7,066,071 B2
(45) Date of Patent: Jun. 27, 2006

(54) FOOD SLICER

(75) Inventors: Roland Zeder, New York, NY (US); Thomas J. DeBlasis, Pittsburg, PA (US); Conor P. McNamara, Brooklyn, NY (US); Dean DiPietro, Brooklyn, NY (US)

(73) Assignee: Helen of Troy Limited, Bridgetown (BB)

( * ) Notice: Subject to any disclaimer, the term of this patent is extended or adjusted under 35 U.S.C. 154(b) by 0 days.

(21) Appl. No.: 10/428,055

(22) Filed: May 1, 2003

(65) Prior Publication Data

US 2004/0216579 A1 Nov. 4, 2004

(51) Int. Cl.
*B26D 7/06* (2006.01)
*B26D 1/00* (2006.01)

(52) U.S. Cl. ..... 83/698.11; 83/856; 30/278

(58) Field of Classification Search ..... 83/699, 83/720, 28, 105, 158, 401, 418, 420, 703, 83/4, 425.3, 431, 437, 717, 858, 856, 435.11, 83/954, 437.2, 857, 955, 932, 440.2, 698.11; D7/673, 678, 693, 106; 30/278, 279.6, 280; 241/95, 100, 168, 169, 257.1, 273.1, 273.4, 241/285.2

See application file for complete search history.

(56) References Cited

U.S. PATENT DOCUMENTS

| | | | | | |
|---|---|---|---|---|---|
| 44,547 | A | * | 10/1864 | Morahan | 83/856 |
| 221,436 | A | * | 11/1879 | Andrews | 83/856 |
| 1,416,723 | A | * | 5/1922 | Krafft | 30/284 |
| 1,974,194 | A | * | 9/1934 | Phillips | 241/101.1 |
| 2,192,362 | A | * | 3/1940 | Merlo | 30/32 |
| 2,261,743 | A | * | 11/1941 | Murcic | 83/857 |
| 2,584,737 | A | * | 2/1952 | Popeil | 83/698.11 |
| 2,786,503 | A | * | 3/1957 | Lewis | 83/857 |
| 2,991,814 | A | * | 7/1961 | Popeil | 83/105 |
| 3,208,142 | A | * | 9/1965 | Osrow | 30/140 |
| 3,271,075 | A | * | 9/1966 | Good | 297/423.41 |
| 3,583,454 | A | * | 6/1971 | Borner | 241/95 |
| 3,825,049 | A | * | 7/1974 | Swett et al. | 220/771 |
| 3,890,867 | A | | 6/1975 | Wislon | |
| 3,938,602 | A | | 2/1976 | Sly et al. | |
| 3,942,399 | A | | 3/1976 | Giangiulio | |
| 3,948,132 | A | * | 4/1976 | Camp | 83/425.3 |
| 4,038,892 | A | * | 8/1977 | Popeil | 83/874 |
| D249,044 | S | | 8/1978 | Popeil | |

(Continued)

FOREIGN PATENT DOCUMENTS

DE 7802693 GM 7/1978

(Continued)

OTHER PUBLICATIONS

Photocopy of packaging for KiMee Grater dated: prior to May, 2002.

*Primary Examiner*—Allan N. Shoap
*Assistant Examiner*—Ghassem Alie
(74) *Attorney, Agent, or Firm*—Seyfarth Shaw LLP

(57) ABSTRACT

A food slicer includes a frame with a food-receiving platform having an aperture therein. A reversible cutting blade has first and second cutting edges and is selectively removably mountable on the frame in first and second positions for respectively disposing the first and second cutting edges in the aperture for engagement with food being moved along the platform. Support legs are rotatably carried by the frame for movement between a stowed position disposed against the frame entirely between inner surfaces of side walls thereof and a use position extending from the frame and laterally outwardly of the inner surfaces of the side walls.

7 Claims, 9 Drawing Sheets

U.S. PATENT DOCUMENTS

| | | | | | |
|---|---|---|---|---|---|
| 4,184,397 | A | | 1/1980 | Jones | |
| 4,198,887 | A | * | 4/1980 | Williams, Jr. | 83/356.3 |
| 4,212,431 | A | * | 7/1980 | Doyel | 241/100 |
| 4,281,460 | A | | 8/1981 | Harris | |
| D275,441 | S | * | 9/1984 | Becker et al. | D7/381 |
| 4,561,622 | A | * | 12/1985 | Heinzel | 248/439 |
| 4,570,519 | A | * | 2/1986 | Motosko, II | 83/856 |
| 4,592,113 | A | * | 6/1986 | Selfors | 452/137 |
| 4,733,588 | A | * | 3/1988 | Yamamoto | 83/857 |
| 4,733,589 | A | | 3/1988 | Wolff | |
| 4,756,083 | A | | 7/1988 | Alonso | |
| 4,838,180 | A | * | 6/1989 | Gutgsell | 108/132 |
| 5,101,702 | A | | 4/1992 | Kuchler | |
| 5,129,298 | A | | 7/1992 | Cresson et al. | |
| 5,477,761 | A | * | 12/1995 | Holtsch | 83/221 |
| 5,499,664 | A | * | 3/1996 | Figiel et al. | 140/152 |
| 5,572,794 | A | * | 11/1996 | Kalbern | 30/353 |
| 5,581,889 | A | * | 12/1996 | Reuter | 30/142 |
| D379,745 | S | * | 6/1997 | So | D7/673 |
| 5,745,999 | A | | 5/1998 | Zirkiev | |
| 5,784,936 | A | | 7/1998 | King | |
| 5,787,776 | A | | 8/1998 | Nishimoto | |
| 5,802,723 | A | | 9/1998 | Haggar | |
| D400,767 | S | * | 11/1998 | de Saint-Genois | D7/673 |
| D410,366 | S | * | 6/1999 | Chiasson | D7/673 |
| 6,044,739 | A | | 4/2000 | Abler et al. | |
| 6,082,645 | A | * | 7/2000 | Himmighofen et al. | 241/168 |
| 6,148,704 | A | | 11/2000 | Lewis | |
| 6,167,791 | B1 | | 1/2001 | Heckman et al. | |
| 6,209,438 | B1 | | 4/2001 | Mitchell et al. | |
| 6,318,222 | B1 | * | 11/2001 | Weinman, Jr. | 83/13 |
| 6,732,622 | B1 | * | 5/2004 | Vincent | 83/247 |
| 2002/0112583 | A1 | * | 8/2002 | Wong | 83/167 |

FOREIGN PATENT DOCUMENTS

| | | |
|---|---|---|
| DE | 2727358 | 1/1979 |
| DE | 2816929 | 5/1982 |
| DE | 2857743 | 12/1982 |
| DE | 8519124 GM | 10/1985 |
| DE | 3500959 | 7/1986 |
| DE | 3604477 | 3/1987 |
| DE | 3700012 | 6/1988 |
| DE | 9110587 GM | 1/1992 |
| DE | 9206592 GM | 9/1992 |
| DE | 9306627 GM | 8/1993 |
| DE | 4304228 | 9/1994 |
| DE | 9410072 GM | 12/1994 |
| DE | 29612341 GM | 10/1996 |
| DE | 29803375 GM | 7/1998 |
| GB | D2045614 | 6/1995 |
| GB | D2046145 | 7/1995 |
| JP | 573578 | 1/1982 |
| JP | U-57-043995 | 3/1982 |
| JP | 591990 | 10/1982 |
| JP | 687684 | 6/1986 |
| JP | 687684-1 | 6/1986 |
| JP | 740941 | 5/1988 |
| JP | 764098 | 3/1989 |
| JP | 774941 | 8/1989 |
| JP | 794065 | 5/1990 |
| JP | 878599 | 6/1993 |
| JP | 1034609 | 1/1999 |
| JP | 1035882 | 1/1999 |
| JP | A-11-169306 | 6/1999 |
| JP | A-11-318724 | 11/1999 |
| JP | U-3065468 | 2/2000 |
| JP | A-2000-201840 | 7/2000 |
| JP | 1095144 | 10/2000 |
| JP | 1101572 | 12/2000 |
| JP | 1101589 | 12/2000 |
| JP | 1130095 | 11/2001 |
| WO | WO 99/43246 | 9/1999 |

* cited by examiner

FOOD SLICER

BACKGROUND

This application relates to food cutting and slicing devices and, in particular, to devices of the type for moving food items past a substantially stationary cutting or slicing blade.

Various types of food slicing devices have heretofore been provided. Many of these devices are rather bulky and consume considerable storage space. It is known to provide food slicing devices which are somewhat foldable or collapsible for storage purposes, but they are still not very compact.

It is also known to provide food slicing devices which have combinations of blades to effect different types of slicing or cutting patterns in the food. One such arrangement has a rotatable mount carrying plural groups of slitting blades which can be selectively rotated into the path of the food items, and a stationary slicing blade positioned downstream of the slitting blades for slicing the slit food portions. The slicing blade is typically fixed in the device and only a single such blade is provided.

SUMMARY

This application discloses an improved food slicer which avoids the disadvantages of prior food slicing devices, while affording additional structural and operating advantages.

In particular, there is described a food slicer which is of compact construction and, specifically, is foldable to a compact storage configuration.

Another aspect is the provision of a food slicing device of the type set forth, which has a reversible slicing blade to greatly increase the flexibility of the device and the number of different slicing patterns which it can achieve.

Specifically, there has been described a food slicer comprising a frame, a food-receiving platform carried by the frame and having an aperture therein, and a reversible cutting blade having first and second cutting edges and being selectively removably mountable on the frame in first and second positions. The cutting blade in its first position has the first cutting edge disposed in the aperture for cutting engagement with food being slid in a predetermined direction along the platform, the cutting blade in its second position having the second cutting edge disposed in the aperture for cutting engagement with food being slid in the predetermined direction along the platform.

BRIEF DESCRIPTION OF THE DRAWINGS

For the purpose of facilitating an understanding of the subject matter sought to be protected, there is illustrated in the accompanying drawings an embodiment thereof, from an inspection of which, when considered in connection with the following description, the subject matter sought to be protected, its construction and operation, and many of its advantages should be readily understood and appreciated.

DETAILED DESCRIPTION

Figure 1:
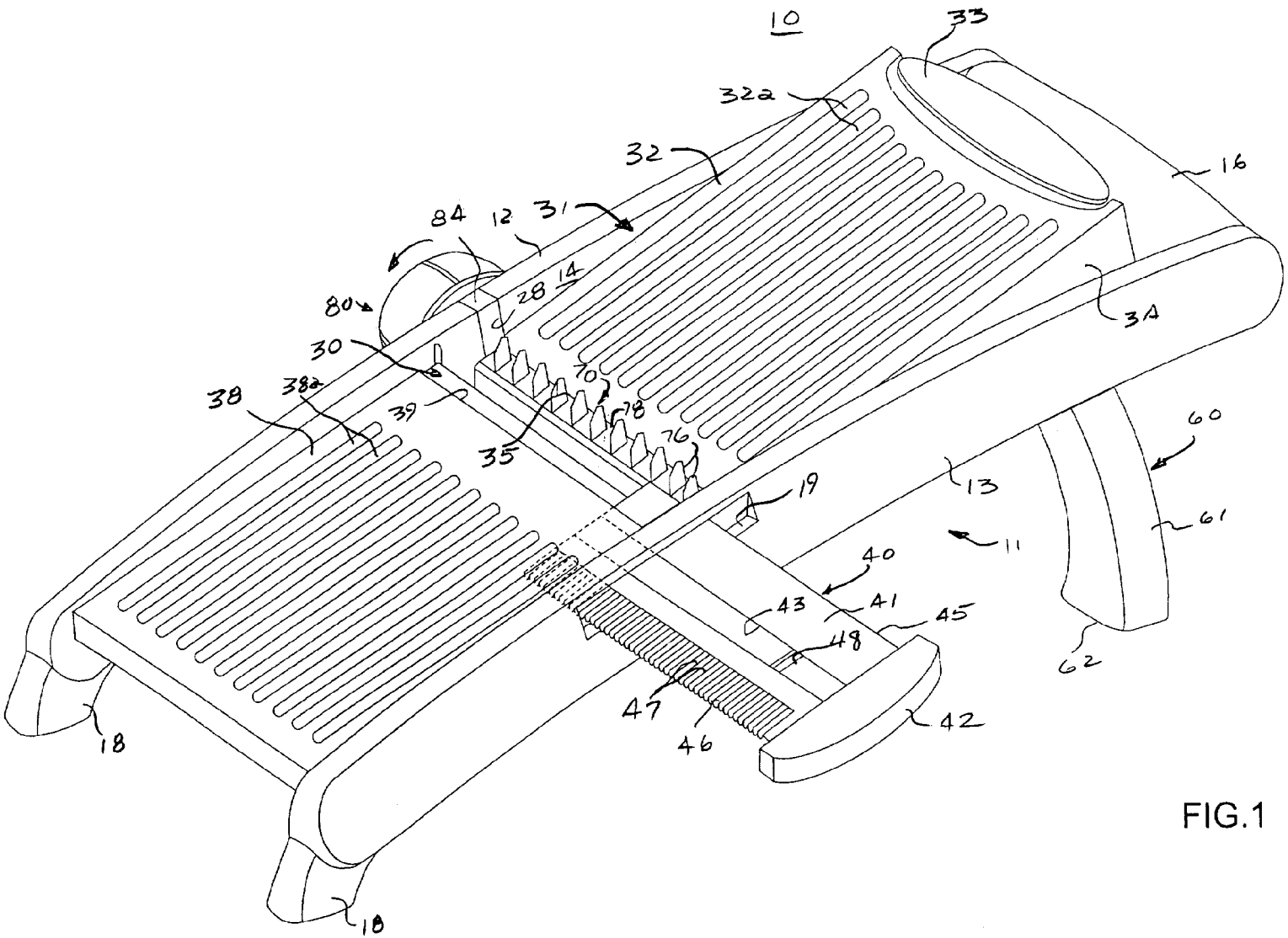
FIG. 1 is a perspective view of an embodiment of food slicer, with a removable blade in a first orientation, fully retracted, and with a rotor assembly in a first position.

Referring to FIGS. 1–6, there is illustrated a food slicer, generally designated by the numeral 10, which includes an open frame 11, generally rectangular in shape, including a pair of substantially parallel sidewalls 12 and 13, respectively having inner surfaces 14 and 15 which face toward each other. The sidewalls 12 and 13 are interconnected adjacent to a rear end thereof by a rear beam 16, and are interconnected adjacent to a front end thereof by a front beam (not shown). Respectively integral with the sidewalls 12 and 13 at the front ends thereof and extending downwardly and forwardly therefrom are short stub legs 18. Formed through the sidewall 13 intermediate its ends is a long, narrow, rectangular opening 19. Each of the sidewalls 12 and 13 is provided adjacent to its rear end with a laterally inwardly projecting cam projection 20 (FIG. 4) having a sloping cam surface 21 and a flat bearing surface 22 disposed substantially parallel to the adjacent inner surface 14 or 15 of the associated sidewall. Formed in each of the inner surfaces 14 and 15, respectively just below the cam projections 20, are shallow cylindrical recesses 23.

Figure 6:
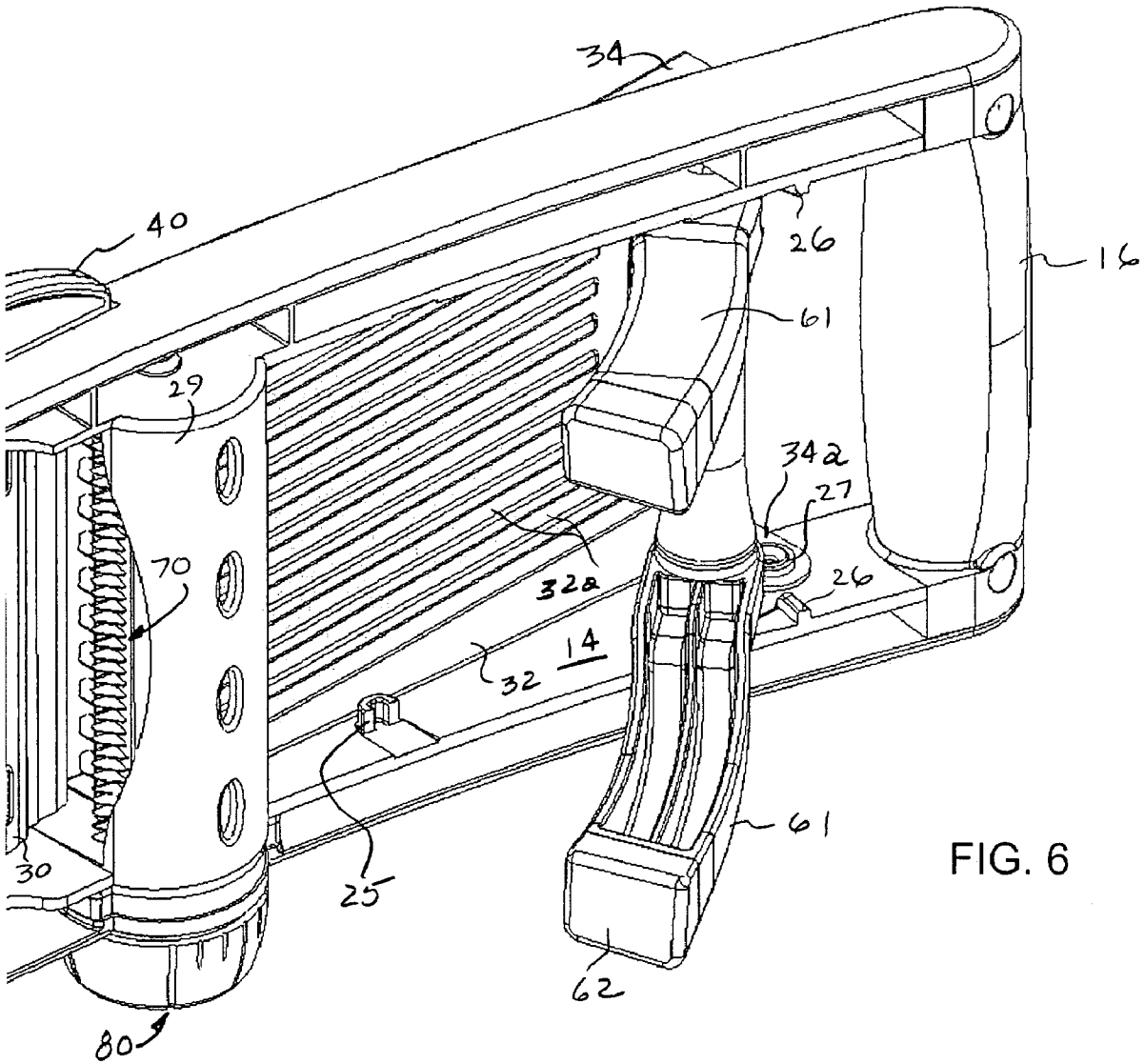
FIG. 6 is a fragmentary bottom perspective view of the food slicer of FIG. 1 with the removable blade installed and with the rear legs partially extended.

Referring to FIG. 6, the sidewalls 12 and 13 are respectively provided with laterally inwardly projecting stop lugs 25 just rearwardly of the rectangular opening 19, and are also provided with laterally inwardly projecting stop lugs 26, respectively below and just rearwardly of the recesses 23. Projecting laterally inwardly from each of the side walls 12 and 13 forwardly of the rear beam 16 is a pivot lug 27. Formed in the upper edge of the sidewall 12 intermediate its ends is a rectangular rotor notch 28, beneath which is a rotor aperture (not shown), both for a purpose to be explained more fully below. Spanning the sidewalls 12 and 13 along the lower edges thereof adjacent to the notch 28 is a substantially semi-cylindrical guard 29. Also interconnecting the sidewalls 12 and 13 immediately beneath the rectangular opening 19 is a flat, substantially rectangular support 30, which may have flexible and resilient fingers 30*a* cut therefrom. All of the foregoing form part of the frame 11 and may be formed of a suitable plastic material.

Carried by the frame 11 is a platform assembly 31, which includes a rectangular infeed plate 32, which may be provided with longitudinally extending and laterally spaced-apart ribs 32*a*. The infeed plate 32 is dimensioned to fit between the sidewalls 12 and 13 between the rear beam 16 and the rectangular opening 19 and is provided at its rearward end with a handle pad 33. Integral with the plate 32 along its opposite side edges are depending side flanges 34, respectively parallel to the inner surfaces 14 and 15 of the sidewalls 12 and 13 and respectively having legs 34*a* depending from the rearward ends thereof and respectively pivotally coupled to the sidewalls 12 and 13 at the pivot lugs 27. The infeed plate 32 has a straight front edge 35 disposed in use substantially perpendicular to the sidewalls 12 and 13 so that, in use, it defines a rear end of a generally rectangular gap or aperture 37 in the platform assembly 31, the forward end of which is defined by a discharge plate 38. The plate 38 is also rectangular in shape and occupies the space between the sidewalls 12 and 13 at the forward end thereof, being fixedly secured thereto by suitable means. The plate 38 may be provided with longitudinally extending and laterally spaced-apart ribs 38*a* and has a straight rear edge 39 disposed in use substantially perpendicular to the sidewalls 12 and 13. The forward end of the discharge plate 38 may have a depending flange which covers and conceals the front beam 17.

Figure 2:
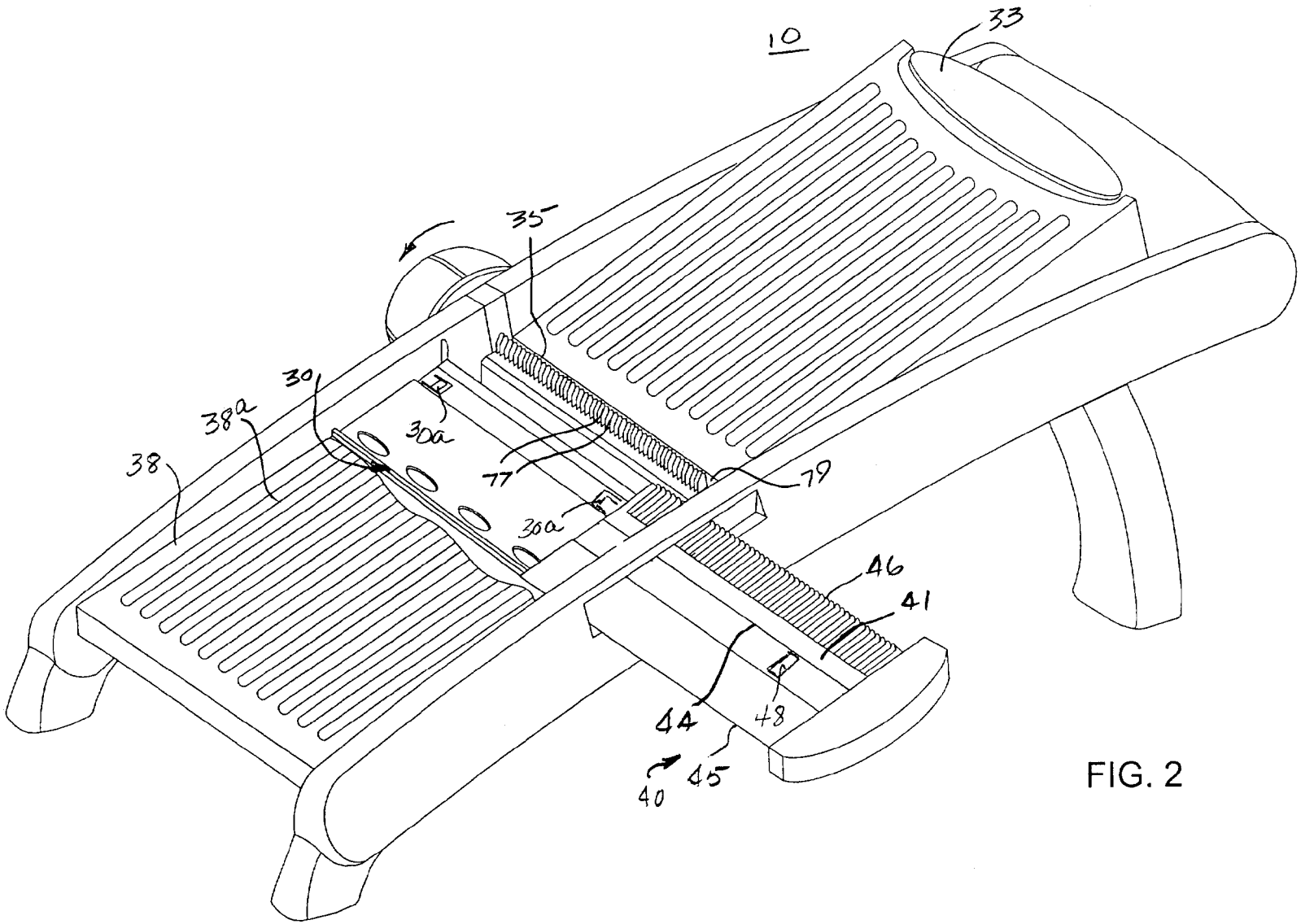
FIG. 2 is a view similar to FIG. 1, with a portion broken away, with the removable blade in a second orientation and partially retracted, and with the rotor assembly in a second position.
Figure 8:
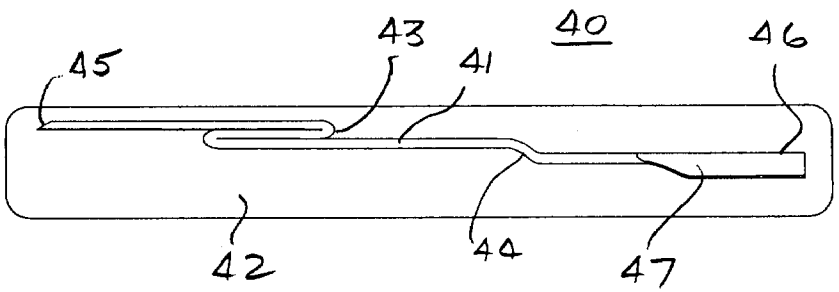
FIG. 8 is an enlarged end elevational view of the reversible blade of the slicer of FIG. 1.
Figure 7:
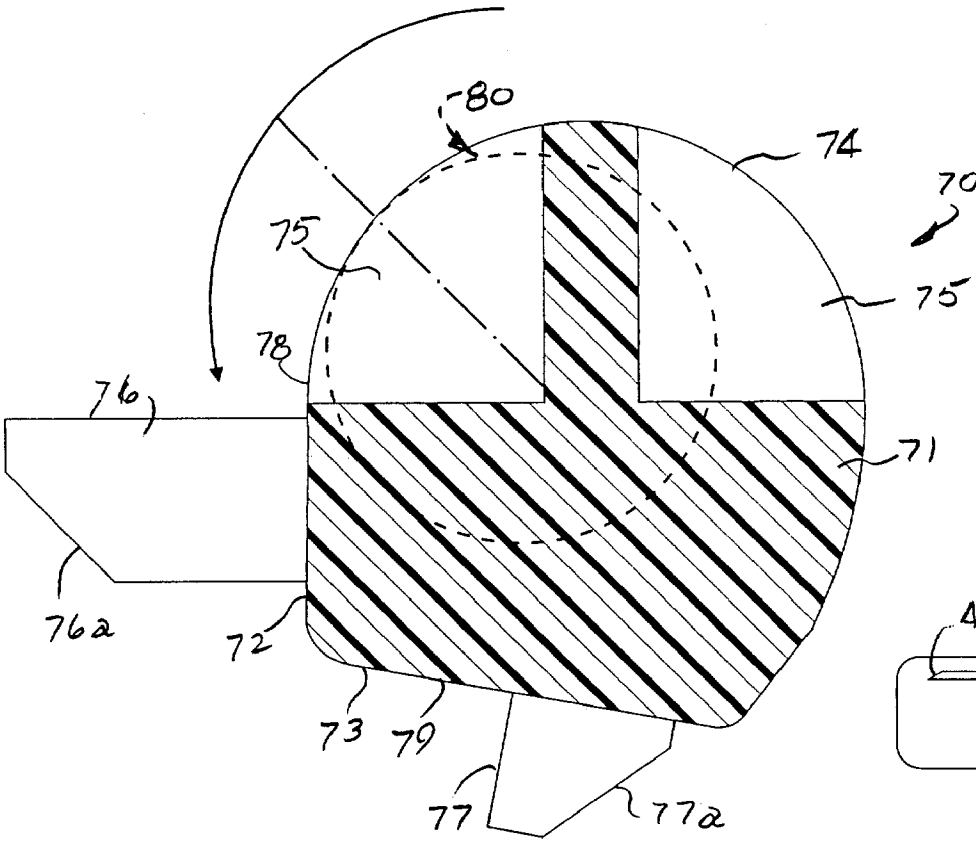
FIG. 7 is a further enlarged sectional view of the rotor assembly taken generally along the line 7—7 in FIG. 4.

Referring in particular to FIGS. 1, 2 and 8, the food slicer 10 includes a reversible blade 40 having an elongated, rectangular, generally flat body 41 which may be of unitary one-piece construction and is provided at one end thereof with an enlarged handle 42. The body 41 may be formed of a sheet metal plate which has folds and bends therein so as to be generally z-shaped in transverse cross section and to define a longitudinally extending shoulder 43 on one surface thereof and a shoulder 44 on the opposite surface thereof The body 41 defines a first longitudinally extending blade edge 45 along one side thereof and a second blade edge 46 along an opposite side thereof, the blade edge 46 including a plurality of flutes or serrations 47. At least one rectangular opening 48 may be formed through the body 41. The reversible blade 40 is dimensioned to be received in the rectangular opening 19, as illustrated in FIGS. 1 and 2, overlying and supported by the support 30, until the distal end thereof engages the sidewall 12, whereupon one of the fingers 30*a* snaps into the opening 48 to retain the reversible blade 40 in place. The handle 42 is preferably dimensioned so that it will not pass through the opening 19. As can be seen from FIGS. 1 and 2, the blade 40 is reversible so that either the blade edge 45 (FIG. 1) or the blade edge 46 (FIG. 2) may be disposed rearwardly.

The frame 11 is provided with a foldable rear leg assembly 50 which includes an elongated axle 51 (FIGS. 3, 4 and 6) which may be substantially circular in transverse cross section along most of its length, and is provided with sloping or inclined end surfaces 52, which are inclined toward each other so as to be non-perpendicular to the longitudinal axis of the axle 51. Projecting axially from each of the sloping end surfaces 52 is an extension 53 which is substantially square in transverse cross section, each extension 53 being in turn provided with an axially projecting, substantially cylindrical pivot stub 54 adapted to the coaxially and rotatably received in an associated one of the pivot recesses 23 in the sidewalls 12 and 13 (FIG. 4). Each of the extensions 53 has a cylindrical pin bore 55 formed therethrough.

Respectively mounted on the opposite ends of the axle 51 are the two elongated legs 60, each having an elongated body 61 which is substantially rectangular in transverse cross sectional outline and is provided at its distal end with a rectangular foot 62. Each leg 60 has an attachment end 63 with a substantially square aperture 64 formed therethrough for receiving an adjacent square extension 53 of the axle 51. Also formed through the each attachment end 63 is a pin bore 65 which is disposable in alignment with pin bore 55 in the associated axle extension 53 for receiving a suitable attachment pin 68. Projecting laterally outwardly from each attachment end 63 is a generally rectangular follower lug 67 disposable for camming engagement with the cam surface 21 and bearing surface 22 of the associated cam projection 20 of the adjacent one of the sidewalls 12 and 13.

Referring in particular to FIGS. 1, 2, 4 and 7, the food slicer 10 also includes a rotor assembly, generally designated by the numeral 70, which extends between the sidewalls 12 and 13 and overlies the guard 29. The rotor assembly 70 includes an elongated body 71, which has flat surfaces 72 and 73 along adjacent sides and inclined with respect to each other at an angle of approximately 100°. Interconnecting the flat surfaces 72 and 73 is a cam surface 74 which is actuate in shape along most of its extent. Formed in the body 71 are a plurality of longitudinally spaced-apart, generally wedged-shaped recesses 75. Projecting laterally from the flat surface 72 are a plurality of longitudinally spaced-apart, relatively long blades 76, each having a beveled surface 76*a* at its distal end along its leading (in direction of rotation) edge. Projecting laterally from the flat surface 73 are a plurality of longitudinally spaced-apart, relatively short blades 77, each having a beveled surface 77*a* at its distal end along its leading edge. The longitudinal spacing of the blades 77 is substantially less than that of the blades 76, so that there are more of the blades 77 than the blades 76. It will be appreciated, however, that the numbers, spacing and lengths of the blades 76 and 77 may be varied, as desired. The junction between the flat surface 72 and the cam surface 74 defines a support ledge 78, while the portion of the flat surface 73 adjacent to the flat surface 72 defines a support ledge 79, for a purpose to be explained more fully below. The body 71 may be provided at its opposite ends with longitudinally extending, coaxial stub shafts 79*a*, 79*b* (see FIG. 4), one of which is adapted to be received in a complementary cylindrical recess in the sidewall 13, and the other which is adapted to extend through the complementary opening (not shown) in the sidewall 12, just below the notch 28.

Figure 9:
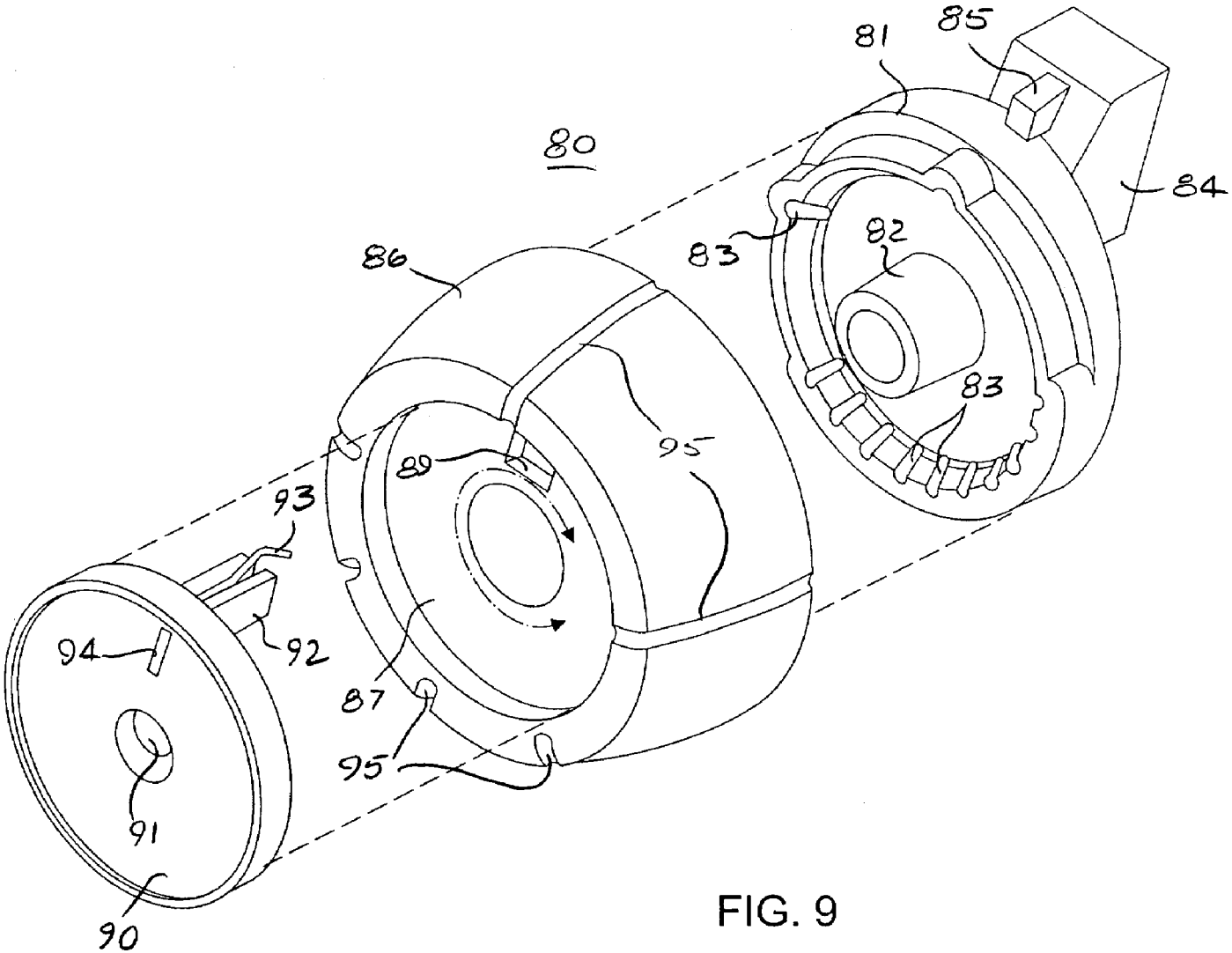
FIG. 9 is an enlarged, exploded, perspective view of the knob assembly of the rotor assembly of the food slicer of FIG. 1.

Referring also to FIG. 9, the rotor assembly 70 includes a knob assembly, generally designated by the numeral 80. The knob assembly 80 includes a circular base plate 81 having a central circular aperture therethrough encircled by a cylindrical hub 82. A plurality of circumferentially spaced detent recesses 83 are formed along the inner surface of a cylindrical flange of the base plate 81 which is substantially coaxial with the hub 82. Integral with the base plate 81 and projecting axially and radially from the side thereof opposite the hub 82 is a mounting block 84 dimensioned to be received in the rotor notch 28 in the sidewall 12 (see FIG. 4). When so mounted, the hub 82 will be coaxial with the rotor aperture in the sidewall 12 for receiving the stub shaft 79*b* of the rotor assembly. Projecting axially from the mounting block 84 so as to overlie the outer periphery of the base plate 81 is an indicator lug 85.

The knob assembly 80 also includes a generally cup-shaped cover 86 having a recessed circular end wall 87 having a central circular aperture therethrough surrounded by a cylindrical hub 88. Formed through the end wall 87 just radially outside the hub 88 is an rectangular aperture 89. The knob assembly 80 also includes a circular control plate 90 with a cylindrical hub 91 centrally thereof surrounding a central aperture therethrough, and a generally rectangular support arm 92 projecting axially therefrom adjacent to the outer periphery thereof and carrying a detent spring finger 93. Formed in the control plate 90 substantially in alignment with the support arm 92 is a positioning slot 94. Formed in the outer surface of the sidewall of the cover 86 are circumferentially spaced-apart indicia grooves 95.

In assembly, the control plate 90 is fitted against the outer surface of the recessed end wall 87 of the cover 86, with the hub 91 and the support arm 92 of the control plate being respectively received in the hub 88 and the aperture 89 of the cover 86. The base plate 81 is then fitted against the rear of the cover/control plate assembly, with the hub 82 disposed in coaxial alignment with the hub 91 and with the detent spring finger 93 being disposed for engagement in the detent recesses 83. The mounting block 84 is then fitted into the notch 28 and the frame sidewall 12, to receive the stub shaft 79*b* of the rotor assembly 70 in alignment with the hub 82. A screw 96 is then extended through the aligned hubs 82, 88 and 91 and threadedly engaged in the stub shaft 79*b* to secure the cover 86 and control plate 90 of the knob assembly 80 together and with the rotor assembly 70, so that the knob assembly 80 and the rotor assembly 70 may rotate together as a unit and relative to the base plate 81. When the cover 86 of the knob assembly 80 is rotated, as the indicia grooves 95 respectively align with the indicator lug 85, the detent spring finger 93 will engage a corresponding one of the detent recesses 83 to give a tactile indication of the arrival at the selected position and to resiliently retain the assembly in that position. Two of the widely-spaced indicia grooves 95 respectively correspond to the rotor assembly positions illustrated in FIGS. 1 and 2, with the different slitting blade sets in use position, and the closely-spaced indicia grooves respectively correspond to the height adjustments of the infeed plate 32 by the cam surface 74 of the rotor assembly 70.

Figure 10:
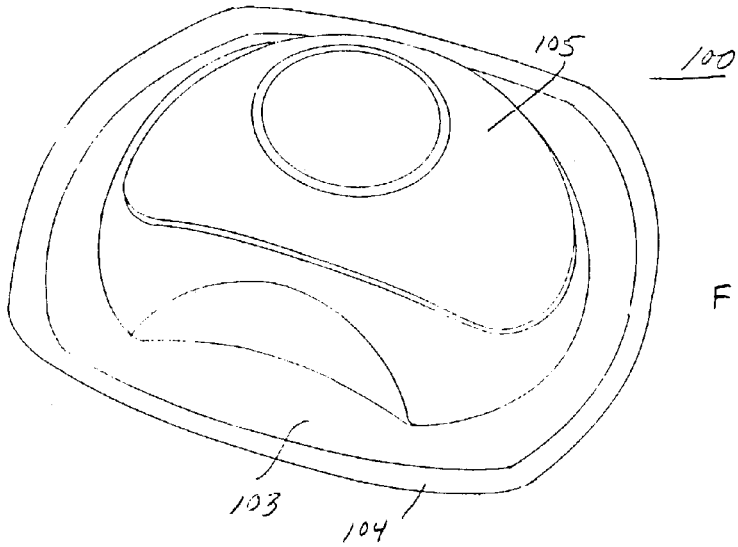
FIG. 10 is a perspective view of a food holder for use with the food slicer of FIG. 1.
Figure 11:
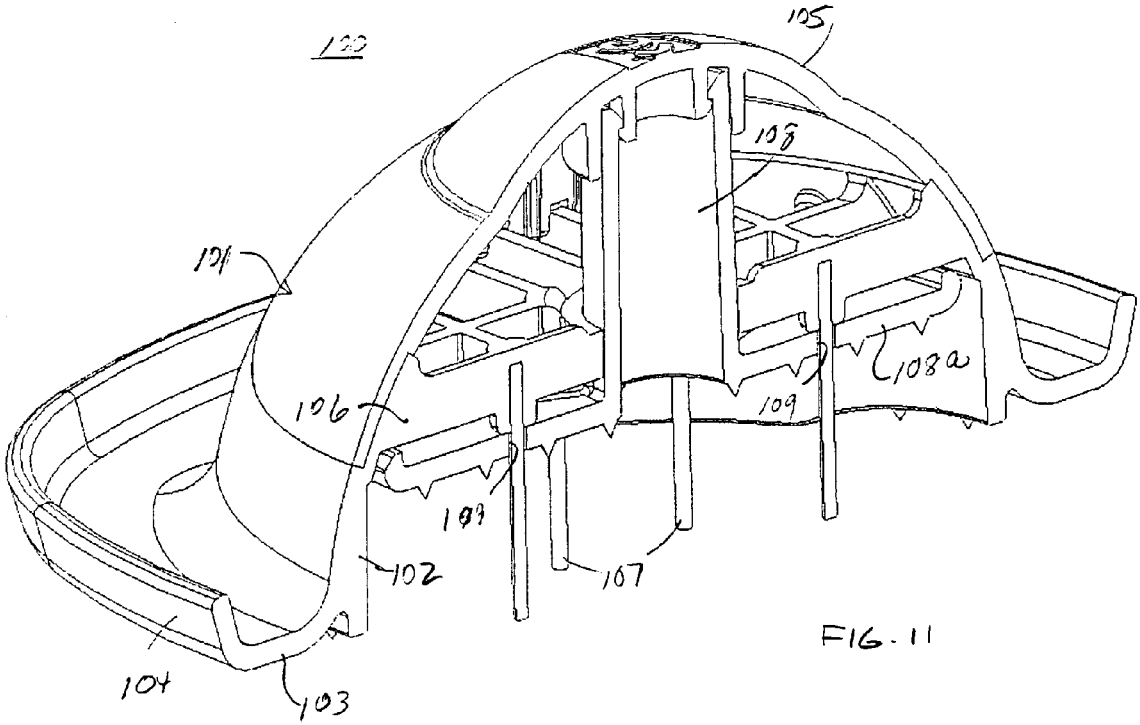
FIG. 11 is an enlarged, perspective, sectional view of the holder of FIG. 10.

Referring now to FIGS. 10 and 11, there is illustrated a food holder 100, adapted for use with the food slicer 10. The food holder 100 has a main body 101 including a base portion 102 provided with a laterally outwardly extending base wall 103 around its periphery, which is generally rectangular in shape and which is, in turn, provided at its outer edge with an upstanding peripheral flange 104. The food holder 100 also includes an actuator portion 105 coupled to the body of 101 and projecting upwardly therefrom and moveable relative thereto. The body 101 is provided with an internal reinforcing lattice 96 which carries a plurality of depending spikes 107. The actuator portion 105 includes a plunger 108 having a base plate 108*a* which is disposed immediately beneath the reinforcing lattice 96 and is provided with a plurality of holes 109 therein for respectively receiving the spikes 107 therethrough. The actuator portion 95 may be biased upwardly to a normal rest position illustrated in the drawings, wherein the base plate 108*a* is disposed against the reinforcing lattice 106.

In use, in the normal rest configuration shown, the spikes 107 project downwardly well below the base plate 108*a* for piercing engagement with an associated article of food to be sliced, with the food article typically projecting downwardly well below the bottom of the base wall 103. This facilitates holding the food article while it is moved relative to the food slicer 10, as will be explained below. As portions of the food article are sliced away, the actuator portion 95 may be depressed to push the food article downwardly along the spikes 107, exposing additional portions for slicing until, eventually, the food article is moved off of spikes 107, all in a known manner.

Figure 3:
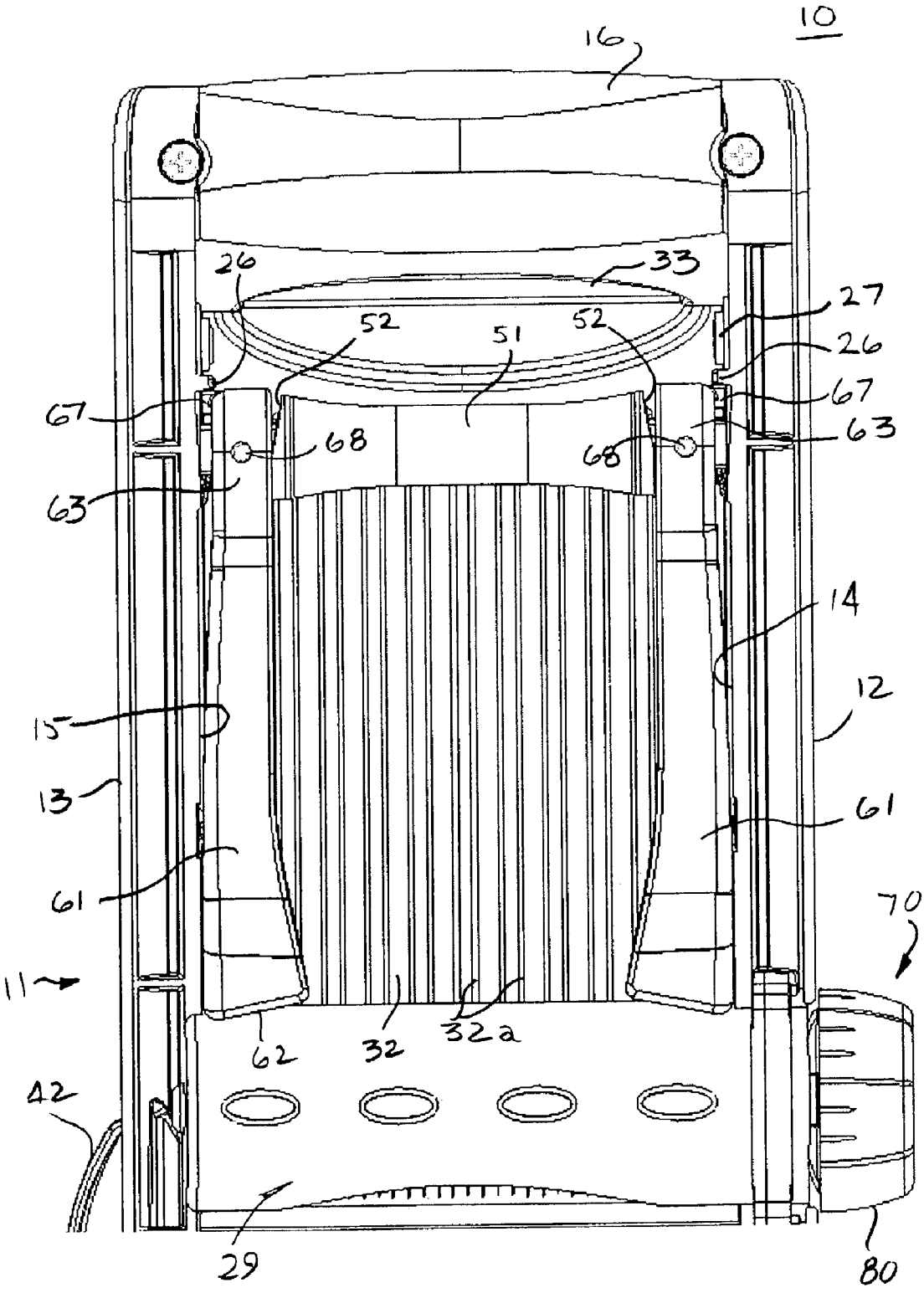
FIG. 3 is a fragmentary bottom plan view of the food slicer of FIG. 1 with its legs disposed in a stowed position.
Figure 4:
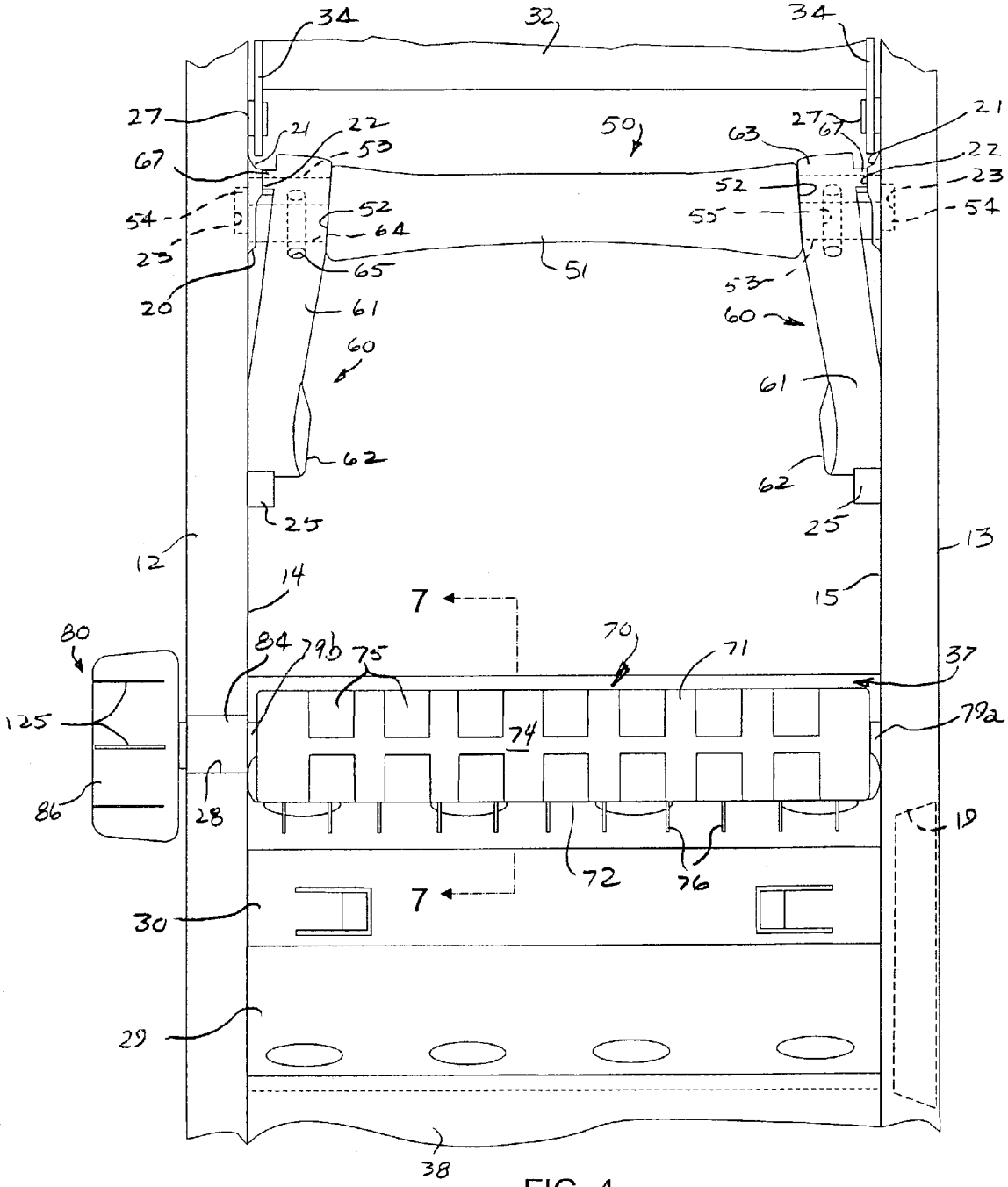
FIG. 4 is an enlarged, fragmentary, top plan view of the food slicer of FIG. 1, with the removable blade and discharge plate removed, with the rotor assembly in a third position, and with the infeed plate raised.
Figure 5:
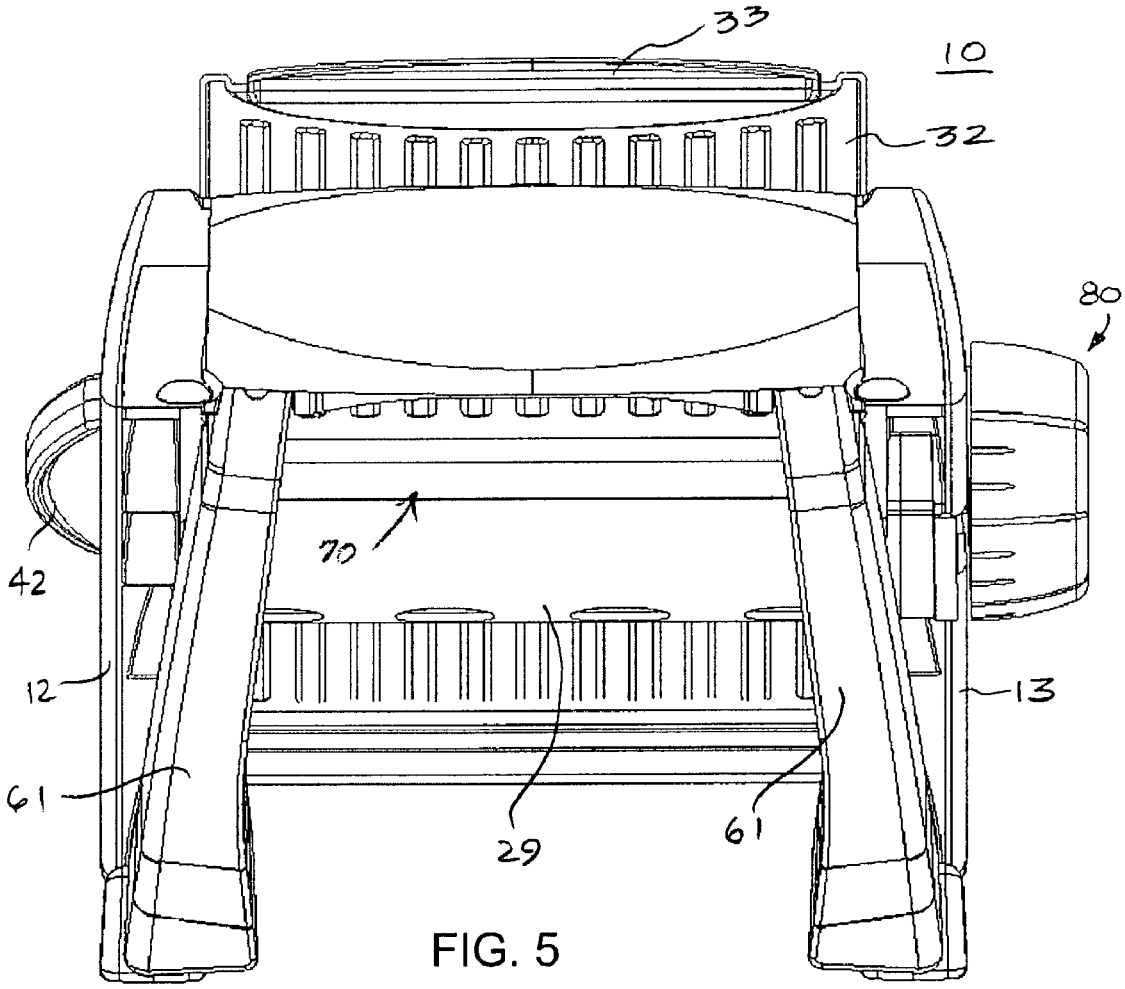
FIG. 5 is an enlarged rear elevational view of the food slicer of FIG. 1.

In use, the rear leg assembly 50 is pivotally movable between an extended use position, illustrated in FIGS. 1, 2, 4 and 5, and a retracted stowed position, illustrated in FIG. 3, FIG. 6 illustrating a position intermediate the use and stowed positions. During movement among these positions, the axle 51 and the legs 60 rotate as a unit about the axis of the axle 51. However, it is a significant aspect of the invention, that the legs 60 are also capable of limited pivotal movement relative to the axle 51 about the axes of the pins 68. It can be seen that, when the legs 60 are in the stowed position, they are disposed entirely between the sidewalls 12 and 13, respectively alongside the inner surfaces 14 and 15, and respectively resting against the stop lugs 25. As the legs 60 are swung from the stowed position to the use position, the follower lugs 67 thereon respectively engage the cam surfaces 21 of the cam projections 20 (see FIG. 4), which tilts the attachment ends 63 of the legs 60 laterally inwardly about the axes of the pins 68, thereby simultaneously tilting the rectangular feet 62 laterally outwardly, this tilting movement of the attachment ends 63 being accommodated by the sloping end surfaces 52 on the axle 51 (see FIGS. 3 and 4). As the legs 60 reach the use position of FIG. 4, wherein they are engaged with the stop lugs 26, the follower lugs 67 ride up onto the bearing surfaces 22 of the cam projections 20, frictionally holding the legs 60 in the use position. In this position, as can be seen, that the legs 60 tilt slightly rearwardly and have their distal ends 62 spread so as to overlap the sidewalls 12 and 13, providing a more secure footing.

With the rear leg assembly 50 in this use position, when the food slicer 10 is supported on an underlying substantially horizontal support surface on its legs 18 and 60, the food slicer frame 11 will be inclined to the underlying support surface, since the legs 60 are substantially longer than the legs 18.

It can be seen that, when the reversible blade 40 is installed in place, it substantially bridges the gap 37 between the infeed plate 32 and the discharge plate 38 of the platform assembly 31, the rear or infeed edge 39 of the plate 38 being disposed against the shoulder 43 (or 44) of the reversible blade 40 so that the upper surface of the plate 38 is substantially flush with the upper surface of the blade body 41.

The rotor assembly 70 is rotatable among three basic conditions, a first condition, illustrated in FIG. 1, wherein the long blades 76 project upwardly through the gap 37, just upstream or rearwardly of the rearwardly facing blade edge of the reversible blade 40. In this condition, the front edge 35 of the infeed plate 32 will rest on the support ledge 78 of the rotor assembly body 71, immediately adjacent to the rear edges of the blades 76. The rotor assembly 70 is adapted to be rotated in the direction of the arrows in FIGS. 1, 2 and 7. It can be seen that, when the rotor assembly 70 is rotated from the condition illustrated in FIG. 1, it will bring the cam surface 74 into engagement with the underside of the infeed plate 32 adjacent to the front edge 35 thereof. The cam surface 74 is shaped so that, as rotation of the rotor assembly 70 continues, the front edge 35 of the infeed plate 32 is gradually raised, thereby elevating the front edge 35 of the infeed plate 32 relative to the rear or infeed edge 39 of the discharge plate 38, for varying the thickness of the slices effected by the exposed blade edge of the reversible blade 40. As can be seen in FIG. 9, there are a plurality of detent stop positions corresponding to different predetermined thickness settings. Continued rotation of the rotor assembly 70 will move it to the condition illustrated in FIG. 2, wherein the short blades 77 are projected upwardly through the gap 37. In this condition, the front edge 35 of the infeed plate 32 will rest on the support ledge 79 of the rotor assembly body 71, immediately behind the blades 77.

It can be seen that, when either the blades 76 or 77 are exposed for use, they cooperate with the exposed blade edge of the reversible blade 40 so that the food article is cut in two different planes, the blades 76, or 77 slitting the food article which is then sliced by the exposed blade edge of the reversible blade 40. In this regard, it will be appreciated that the platform assembly 31 cooperates with the reversible blade 40 to provide a substantially continuous inclined ramp along which the food article is slid repeatedly for repeated slices, all in a known manner.

It can be seen that this arrangement provides great slicing flexibility, wherein either one of the blade edges 45 or 46 of the reversible blade 40 can be used alone to provide a variable-thickness slices, or can be used in combination with either of the sets of slitting blades 76 or 77. It will also be appreciated that the infeed plate 32 may be raised or tilted up about the axis of the pivot lugs 27 to facilitate cleaning of the device, the handle pad 33 facilitating handling for this purpose. The ribs 32*a* and 38*a* on the platform assembly 31 facilitate movement of food articles therealong and inhibit sticking.

In a constructional model of the food slicer 10, the infeed and discharge plates 32 and 38, the reversible blade body 41, the slitting blades 76 and 77, the detents spring finger 93, the pins 68 and the food holder spikes 97 may be formed of suitable metals, and the rest of the structure may be formed of suitable plastic materials.

From the foregoing, it can be seen that there has been provided an improved food slicer which affords great slicing flexibility with a reversible main slicing blade, and provides an improved stowable leg assembly which provides both a narrow-base storage configuration and a wide-base use configuration.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A food slicer comprising:

a frame, a food-receiving platform carried by the frame and having an aperture therein and a discharge portion downstream of the aperture and having a distal edge adjacent to the aperture, and a reversible cutting blade having offset portion in different planes defining shoulders, the cutting blade having first and second cutting edges and being selectively removably mountable on the frame in first and second positions, the cutting blade in its first position having the first cutting edge disposed in the aperture for cutting engagement with food being slid in a predetermined direction along the platform, the cutting blade in its second position having the second cutting edge disposed in the aperture for cutting engagement with food being slid in the predetermined direction along the platform, the shoulders respectively receiving the distal edge when the cutting blade is disposed in the first and second positions.

2. The food slicer of claim 1, wherein the frame has an opening therein for receiving the reversible cutting blade in its first and second positions.

3. The food slicer of claim 1, wherein the cutting blade is substantially rectangular in shape, the first and second cutting edges being respectively disposed along opposite sides of the cutting blade.

4. The food slicer of claim 1, wherein the first and second cutting edges respectively have different configurations.

5. The food slicer of claim 1, and further comprising a plurality of slitting blades carried by the frame upstream of the reversible cutting blade for slitting food being moved in the predetermined directional on the platform before it reaches the reversible cutting blade.

6. The food slicer of claim 5, and further comprising a mount disposed on the frame and carrying the slitting blades and rotatable for selectively moving groups of the slitting blades into slitting positions relative to the platform.

7. The food slicer of claim 1, and further comprising support legs carried by the frame and movable with respect thereto between retracted and extended positions.

* * * * *